United States Patent [19]

Markou et al.

[11] Patent Number: 4,991,395

[45] Date of Patent: Feb. 12, 1991

[54] DEVICE FOR CLEANING THE EXHAUST GASES OF A COMBUSTION ENGINE IN USE

[75] Inventors: Miltiathis Markou, Panorama/Thssaloniki; Konstantin N. Pattas, Thessaloniki, both of Greece

[73] Assignee: Creative Combustion, Ltd., London, England

[21] Appl. No.: 316,040

[22] Filed: Feb. 27, 1989

[30] Foreign Application Priority Data

Feb. 26, 1988 [DE] Fed. Rep. of Germany ..... 3806220
Oct. 25, 1988 [EP] European Pat. Off. ..... 88117761.2

[51] Int. Cl.[5] ..... F02B 47/00

[52] U.S. Cl. ..... 60/295; 123/25 B; 123/25 P

[58] Field of Search ..... 60/295; 123/25 B, 25 P

[56] References Cited

U.S. PATENT DOCUMENTS 3,919,988 11/1975 Bun ..... 123/25 P
4,003,969 1/1977 Robinson ..... 123/25 B
4,341,184 7/1982 Temmerman ..... 123/25 F
4,594,991 6/1986 Harvey ..... 123/25 P
4,802,335 2/1989 Bidwell ..... 60/310

FOREIGN PATENT DOCUMENTS 2932603 2/1981 Fed. Rep. of Germany .
8105682 7/1983 Netherlands ..... 123/25 P
928691 6/1963 United Kingdom .

*Primary Examiner*—Douglas Hart
*Attorney, Agent, or Firm*—Hill, Van Santen, Steadman & Simpson

[57] ABSTRACT

A device for cleaning the exhaust gases of a combustion engine in use for feeding or coating the combustion chambers of an internal combustion engine in use with an alloy containing rare earth elements, especially cerium, comprises a line for water containing hot gas, e.g. exhaust gas of the engine. The hot gas line communicates with the combustion air intake manifold, and comprises a catalytic element through which gas passes and which contains an alloy body made of the rare earth elements.

12 Claims, 3 Drawing Sheets

DEVICE FOR CLEANING THE EXHAUST GASES OF A COMBUSTION ENGINE IN USE

The present invention is concerned with a device for cleaning the exhaust gases of a combustion engine in use, particularly a device for feeding or coating, respectively, the combustion chambers of an internal combustion engine in use with an alloy containing rare earth elements, especially cerium.

It is known that a cerium alloy which is fed in use of an internal combustion engine into the combustion chambers thereof, reduces the harmful pollutant emission, especially that of HC, CO and $NO_x$ compounds, as well as the fuel consumption and increases the specific output. When the cerium alloy is introduced into the combustion chamber in association with water, there will be catalytic decomposition of the water into oxygen and hydrogen. The permanent presence of these two elements permits maintaining the excess air factor during the combustion near the lambda point, whereby the said positive effects are obtained.

It is an object of the invention to modify a device of the kind referred to hereinabove so that in use of the internal combustion engine, particles of an alloy of rare earth elements, especially one containing cerium, can be continually charged into the combustion chamber in a hot, water humidified gas stream in a simple manner.

According to a first aspect of the invention a device for cleaning the exhaust gases of a combustion engine in use, wherein a line for hot gas, which is separate from the fuel supply system of the engine, opens into the combustion air intake manifold, and wherein a catalytic element containing rare earths, particularly cerium, is inserted into said line such that hot gas flowing in said line passes through said catalytic element, is characterized in that said catalytic element comprises an alloy body made of misch metal and that said hot gas is humidified air.

According to a second aspect of the invention in a device as claimed in claim 1 the exhaust gas of the combustion engine is used as hot gas instead of humidified heated air.

Conveniently, the alloy body is formed as a wire coil, while a metal filter may be mounted upstream of the alloy body.

In a simple embodiment of the second aspect of the present invention the line is in communication with the exhaust manifold of the internal combustion engine, so that the exhaust gas of the internal combustion engine is forced by the overpressure prevailing in the exhaust manifold through the catalytic element. The water and also the residual oxygen which are contained in the hot exhaust gases of the internal combustion engine are sufficient to obtain the above described effect especially in the case when the ambient air is humid air.

However, within the meaning of the invention, an improved effect will be obtained with an embodiment in which the line communicates with the atmospheric air and a water tank is designed to be heated and to humidify said atmospheric air. In this case, the "artificially" heated and humidified air which is used as the gas, furnishes at all times sufficient hydrogen and oxygen to obtain the desired effect.

In either of these two embodiments, the hot, humid gas passes through the catalytic element containing the alloy body, in order to remove particles from the latter and carry them into the combustion chamber.

The artificial heating of the atmospheric air is conveniently caused to result by the fact that said line has at least one loop running through the exhaust manifold. In this case, the hot exhaust gases pushed out from the combustion chamber heat up the atmospheric air in the line to the desired temperature, without the provision of a respective separate heating element.

The gas taken from the exhaust manifold can be driven by the overpressure prevailing in the exhaust manifold, whereas when using artificially humidified and heated atmospheric air, the gas is forced through the line by the vacuum prevailing in the intake manifold. If there is no throttle arrangement in the intake manifold, this vacuum is provided for by the air nozzle which will then be provided for the combustion air in the intake manifold.

The device is capable of being used in spark ignited engines as well as in diesel engines.

In the following, the invention is described in more details, by way of further examples, with reference to schematic drawings, in which FIG. 1 is a schematic illustration of a first embodiment according to the invention, in which the hot gas is diverted from the exhaust manifold;

In the figures, identical or functionally identical components have been denoted by the same reference numerals.

Figure 1:
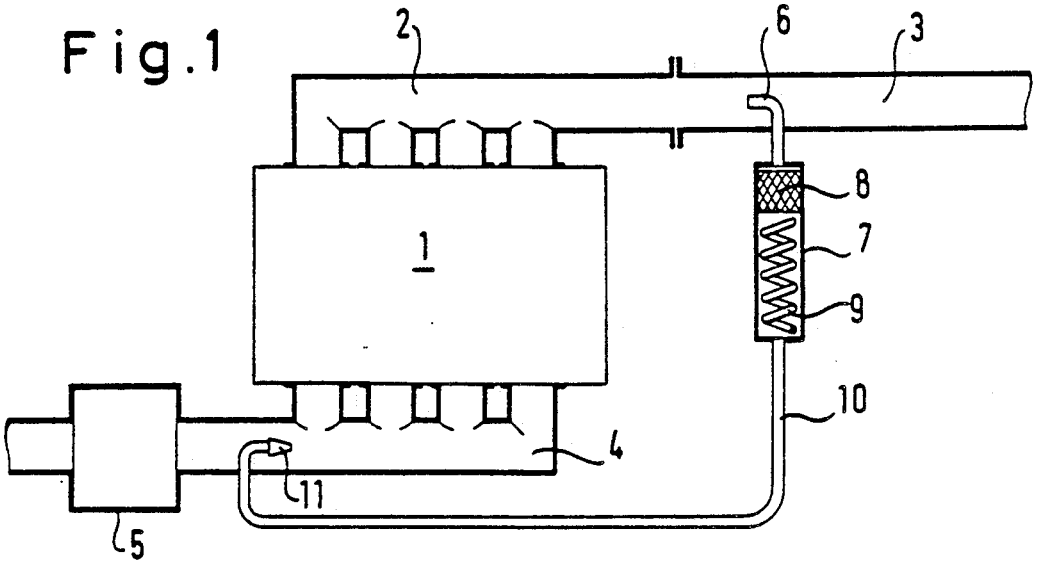

A spark ignited or Diesel engine 1 has an exhaust manifold 2 with an exhaust gas pipe 3 connected thereto, and an intake manifold 4 including an intake air filter 5.

In the embodiment shown in FIG. 1, a suction pipe 6 of a line 10 opens into the exhaust gas pipe 3 in order to extract exhaust gas. The line 10 has its other end connected through the nozzle 11 into the intake manifold 4. Inserted into the line 10 is a catalytic element 7 in the form of a housing and which contains a wire filter 8 and downstream of it a spring coil 9 made of cerium containing alloy of rare earth elements. An example of the composition of the alloy is the so-called misch metal, the composition of which is as follows:

| | |
|---|---|
| Total content of rare earth elements | minimum 99.0% |
| Fe | maximum 0.5% |
| Si | maximum 0.4% |
| Mg | maximum 0.3% |
| Al | maximum 0.2% |

100% rare earth elements contain therein:

| | |
|---|---|
| Ce | about 50% |
| La | 20.0–26.0% |
| Nd | 15.0–19.0% |
| Pr | 5.0–6.0% |

-continued

| | |
|---|---|
| other rare earth elements | 2.0–5.0% |

The coil made of the cerium alloy has a mass of about 60 grams which is sufficient for a running distance of 100,000 km.

When in use, the overpressure existing in the exhaust gas pipe forces part of the exhaust gases via the suction pipe 6 and the catalytic element 7 through the line 10 and into the intake manifold 4. When the hot exhaust gas passes over the coil 9 made of the cerium alloy, the water and the residual oxygen in the exhaust gases then causes the cerium alloy to oxidize and taking particles therefrom to the combustion chamber of the engine.

Figure 2:
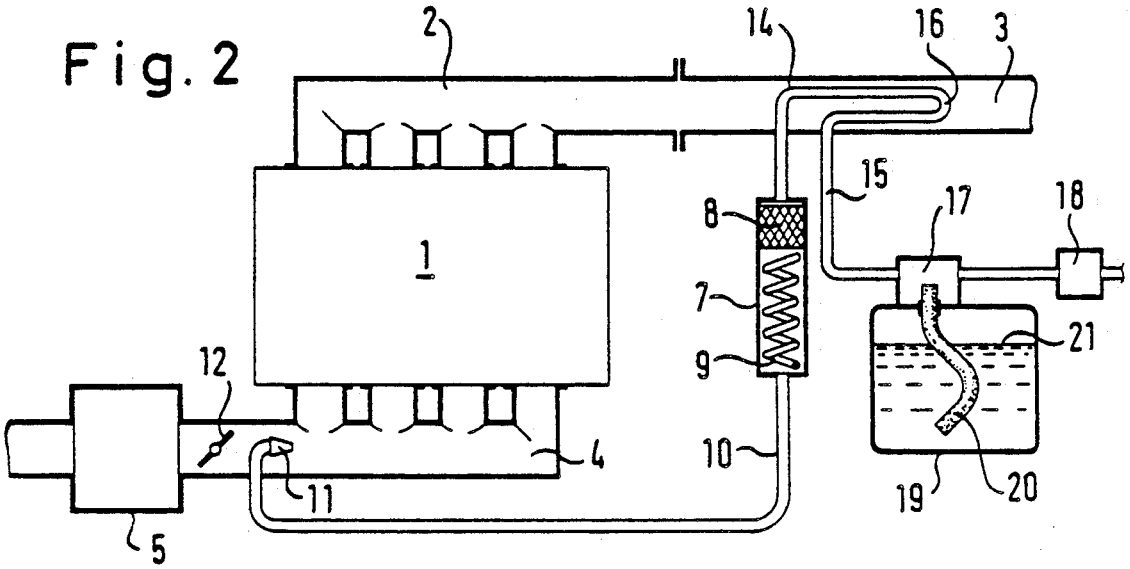
FIG. 2 is a schematic illustration of a second embodiment of the invention in which use is made of artificially humidified and heated atmospheric air.

The main difference between the embodiments shown in FIGS. 1 and 2 consists in that in the latter embodiment, ambient or atmospheric air is used instead of the exhaust gases, the air being filtered across an air filter 18 and transmitted to a humidifying space 17 which communicates via a wick 20 with a tank 19 holding water 21 to which the antifreeze has been added. The air thus humidified is heated by means of a line loop 14, 15, 16 running through the exhaust gas pipe 3 and is then directed through the catalytic element 7 containing the coil 9 of cerium alloy, and via the line 10 into the intake manifold 4, in the same way as described in connection with FIG. 1. The intake manifold is shown to have further a throttle arrangement 12 mounted upstream of the point of entrance of line 10 into the intake manifold 4.

Figure 3:
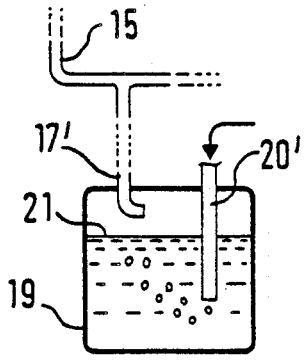
FIG. 3 shows an alternative for humidifying the atmospheric air in the embodiment of FIG. 2.

FIG. 3 shows an alternative arrangement for the humidifying assembly in which, rather than by means of a wick, the air is humidified by the fact that an immersion tube 20' for the auxiliary air is led into the housing 19 to reach a point below the water level so that the air rises again in the form of bubbles and is carried out of the space above the water level through a pipe 17', in humidified condition.

In the embodiments shown in FIGS. 2 and 3 feeding of the auxiliary air is by the vacuum existing in the intake manifold 4. The air also may be pressurized by means of a pressure source, e.g. a compressor, and the pressurized air may be fed through filter 18.

The same applies to the modification shown in FIGS. 4 to 7.

Figure 4:
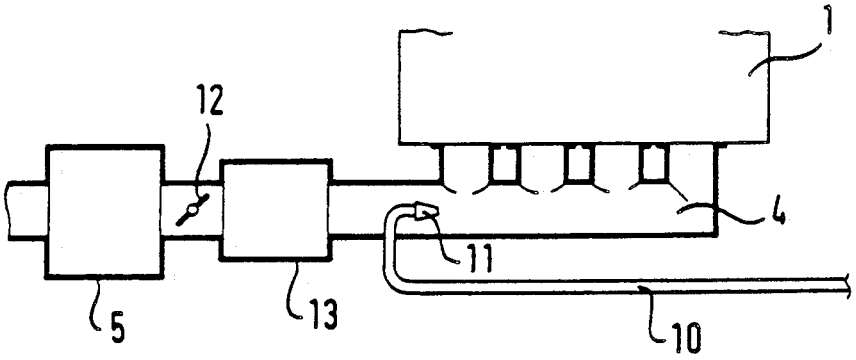
FIGS. 4, 5 and 6 illustrate alternative arrangements for the introduction of the hot gas into the intake manifold.

The embodiment of FIG. 4 differs from that of FIG. 2 in that a mixture forming system 13 is installed downstream of the throttle arrangement 12 at a location upstream of the point of entrance of line 10 into the intake manifold 4.

Figure 5:
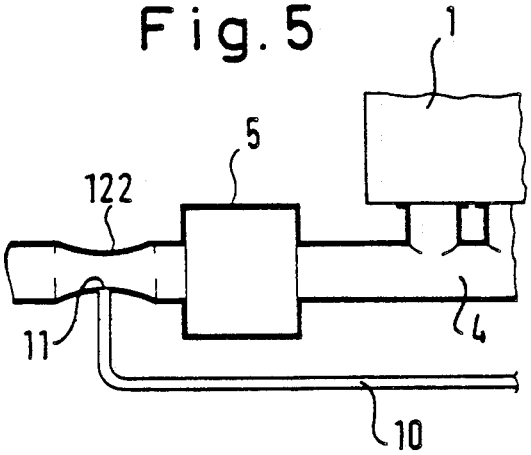
Figure 6:
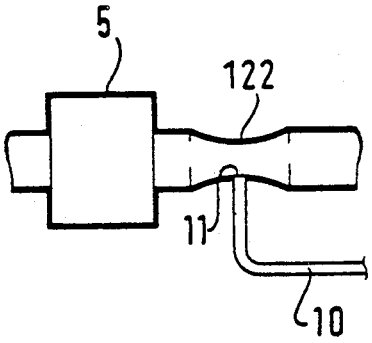

In the embodiments shown in FIGS. 5 and 6, rather than by a throttle arrangement, generation of a vacuum in the intake air is by a nozzle 122 which is arranged upstream (case of FIG. 5) or downstream (case of FIG. 6) of the air filter 5. In both cases, the line 10 connects at the location of nozzle 122 where the air speed has a maximum and the pressure is therefore the lowest.

The water tank 19 may, for example, have a capacity of about 4 liters of water which amount may be enough for approximately 10,000 km of driving in the case of air wetting by means of wick 20 as shown in FIG. 2, or for a running distance of about 5,000 km in the case of the FIG. 3.

The arrangement will continue functioning even when no more water exists in the tank 19, however, the efficiency would be reduced for its decreasing air humidity.

Figure 7:
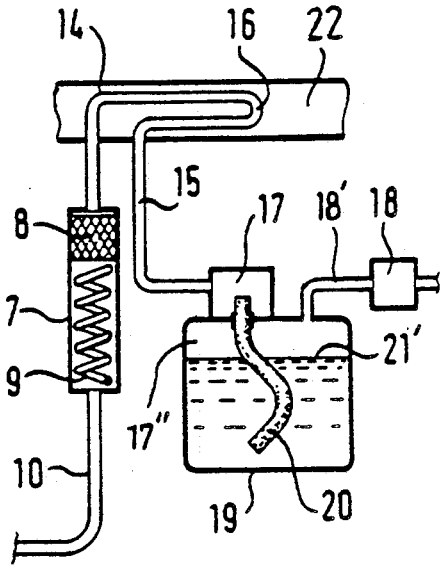
FIG. 7 shows a further alternative for the embodiment of FIG. 2.

The embodiment of FIG. 7 distinguishes from the embodiment of FIG. 2 in two aspects. The main distinction is, that the loop 14, 15, 16 of line 10 runs through a heated cooling or lubricating fluid, which flows in a hose 22, instead of through exhaust gas pipe 3 (FIG. 2). In case that the hose 22 for cooling water of the engine is concerned, such hose is arranged according to the diagram of FIG. 8 in the cooling circuit of the combustion engine.

Figure 8:
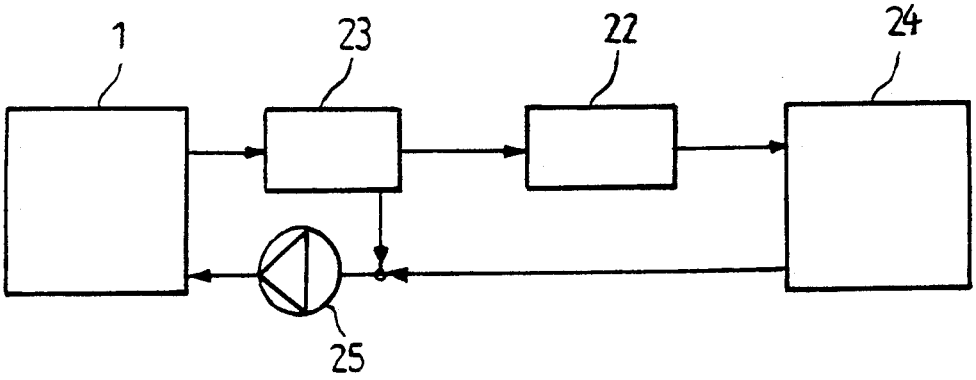
FIG. 8 is a diagram showing a fluid circuit, in which the embodiment of FIG. 2 is applied.

In FIG. 8 reference numeral 23 designates a thermostat, reference numeral 24 a cooler and reference numeral 25 a cooling water pump. Hose 22 contains hot cooling water coming from the engine to heat loop 14, 15, 16 accordingly. Similarly loop 14, 15, 16 also could be arranged in a lubricating oil circuit.

Tests showed, that best results, i.e. the maximum feed of oxidized particles of the catalytic elements 7 into the combustion chamber of the engine, will be established in a temperature range between 80° C. and 100° C. of the humidified hot air. As the temperature of the cooling water exiting from the engine is about 85° C., this kind of heating of the humidified air meets the purposes of the invention at optimum.

A further distinction of the embodiment according to FIG. 7 as compared with the embodiment of FIG. 2 is, that the space 17'' above the water level 21' of water tank 19 is communicated to the space 17 to form a larger humidifying space in total. The air duct 18' which extends from air filter 18, directly communicates with space 17''.

Instead of water also another oxidizing liquid or liquid mixture may be used. For instance an acid or alcohol alone or mixed with water may be used. In practice a mixture of 96 parts water and four parts methanol or a mixture of 90 parts of water and 10 parts of alcohol has been found as satisfying.

What is claimed is:

1. A device for cleaning the exhaust gases of a combustion engine in use, wherein a line for hot gas, which is separate from a fuel supply system of the engine, opens into a combustion air intake manifold, and wherein a catalytic element containing rare earths, particularly cerium, is inserted into said line so that hot gas flowing in said line passes through said catalytic element, the improvements being said catalytic element (7) comprising an alloy body (9) being made of misch metal and said hot gas being humidified air.

2. The device of claim 1, characterized in that the line (10) communicates with the atmospheric air and with a water tank (19) designed to be heated and to humidify said atmospheric air.

3. The device of claim 2, wherein the line (10), in order to obtain its heating, has at least one loop (14, 15, 16) running through an exhaust manifold (2).

4. The device of claim 2, wherein the line (10), in order to obtain its heating, has at least one loop (14, 15, 16) running through a duct portion (22), which contains heated cooling or lubricating fluid of the combustion engine.

5. The device of claim 2, in which the sucked-in combustion air is choked by means of a throttle arrangement (12) mounted in the intake manifold (4), and wherein the humidified hot air is driven by the vacuum prevailing in the intake manifold (4).

6. The device of claim 2, in which the combustion air is introduced into the intake manifold (4) by means of a nozzle (122), and wherein the humidified hot air is driven by the vacuum prevailing in the nozzle (122).

7. The device of claim 2, wherein the atmospheric air is compressed before being humidified and is driven by its compression.

8. The device of claim 2, wherein a wick (20) which extends down into the water tank and protrudes beyond the water level of the water tank (19) functions to deliver water to the hot air passing by.

9. The device of claim 8, wherein above the water level of the water tank (19') a space (17'') is provided for humidifying air, which is introduced into said space by an airsupply-portion (24) of said line (10).

10. The device of claim 2, wherein the hot air is introduced into the water tank (19) below the water level and is drawn at a location above the water level.

11. The device of claim 1, wherein the alloy body (9) is formed as a wire coil and wherein a metal filter (8) is mounted upstream of the alloy body (9).

12. The device of claim 1, wherein the misch metal alloy body contains at least up to about 99% rare earth elements of which cerium makes up for approximately 50%.

* * * * *